US006396447B1

(12) United States Patent
Jonasson

(10) Patent No.: US 6,396,447 B1
(45) Date of Patent: May 28, 2002

(54) ANTENNA UNIT

(75) Inventor: Mats Jonasson, Partille (SE)

(73) Assignee: Volvo Personvagnar AB, Göteborg (SE)

( * ) Notice: Subject to any disclaimer, the term of this patent is extended or adjusted under 35 U.S.C. 154(b) by 0 days.

(21) Appl. No.: 09/669,814

(22) Filed: Sep. 26, 2000

(30) Foreign Application Priority Data

Sep. 27, 1999 (SE) ..... 9903509

(51) Int. Cl.[7] ..... H01Q 1/32
(52) U.S. Cl. ..... 343/713; 343/711
(58) Field of Search ..... 343/713, 745, 343/751, 753, 700 MS, 702, 711; 455/277.1, 77, 132, 500; H01Q 1/32

(56) References Cited

U.S. PATENT DOCUMENTS 4,403,343 A * 9/1983 Hamada ..... 455/134
4,857,999 A * 8/1989 Welsh ..... 358/84
4,926,498 A * 5/1990 Suzuki et al. ..... 455/133
5,049,892 A 9/1991 Lindenmeier et al. ..... 343/773
5,281,974 A * 1/1994 Kuramoto et al. ... 343/700 MS
5,313,660 A 5/1994 Lindenmeier et al. ..... 455/135
5,523,761 A * 6/1996 Gildea ..... 342/357
5,619,214 A * 4/1997 Lindenmeier et al. ..... 343/713
5,719,585 A * 2/1998 Tabata et al. ..... 343/713
5,805,113 A 9/1998 Ogino et al. ..... 343/713
5,933,118 A * 8/1999 Kakizawa ..... 343/713
6,011,518 A * 1/2000 Yamagishi et al. ..... 343/713
6,133,886 A * 10/2000 Fariello et al. ..... 343/702
6,166,698 A * 12/2000 Turnbull et al. ..... 343/713

FOREIGN PATENT DOCUMENTS

EP 0856905 A1 8/1998

* cited by examiner

*Primary Examiner*—Don Wong
*Assistant Examiner*—Trinh Do Dinh
(74) *Attorney, Agent, or Firm*—Kilpatrick Stockton LLP

(57) ABSTRACT

The invention relates to an antenna unit for receiving electromagnetic signals in a vehicle, comprising a plurality of antennae, of which at least one antenna is adapted to receive signals in the GHz range and at least one antenna has an essentially two-dimensional spatial extent, and two or more tuner units, which are each connected to at least one antenna. The antenna unit is characterized in that the output signals from the tuner units are connected to a common coordinating member, and that said antennae, tuner units and coordinating member are arranged on a common supporting element to form an integrated unit. An output signal from the coordinating member is via a communication interface connectable to a vehicle-internal communication path. Antennae and tuner units can be releasably arranged on the supporting element to provide a modularized antenna unit.

11 Claims, 2 Drawing Sheets

ANTENNA UNIT

RELATED PATENT APPLICATIONS

This patent application claims priority to Swedish Patent Application Number 9903509-9 filed Sep. 27 1999. The full disclosure of said application, in its entirety, is hereby expressly incorporated by reference into the present application.

TECHNICAL FIELD

The present invention relates to an antenna unit for receiving electromagnetic signals in a vehicle. The unit comprises two or more antennae and two or more tuner units, which are each connected to at least one of the antennae.

BACKGROUND OF THE INVENTION

Concurrently with the rapid development of communication techniques, the need for receiving and/or transmitting electromagnetic signals of different types in a vehicle increases all the time. This involves, for example, analog and/or digital radio, analog and/or digital TV, mobile telephony, navigation and security information.

To receive these and similar type signals, an increasing number of antennae are mounted in vehicles, usually one antenna for each function. Each such antenna is normally placed in a position which is suitable for the specific antenna: for example, ordinary rod antennae are fixed to the body of the vehicle, wire antennae are cast into the windowpanes, and monopole antennae in the form of plates are mounted in the bumpers of the vehicle.

To mount a plurality of different antennae in a vehicle, a number of mounting steps are necessary and which are both time-consuming and expensive.

When antennae are mounted in windowpanes, there is a conflict: on the one hand, there is the effect of the glass on the receiving properties of the antenna and, on the other hand, there is the climate-protecting properties of the glass. There may be, for example, limitations as to the thickness of the glass because of the radio antenna being cast into the windowpane.

Moreover, each antenna is typically connected to a receiver(tuner) by means of e.g., a coaxial cable. This can result the signal quality decreasing if the distance is too great which is a notable inconvenience. To remedy this inconvenience, antenna boosters are arranged along the extent of the coaxial cable, but this is complicated and makes the installation expensive and does not completely remedy the problem.

In order to avoid long cables between antenna and tuner, tuners can be arranged in direct connection with the antenna. There is, however, still the inconvenience of antennae that are arranged in various positions about the vehicle.

Another problem is that the signal requirements change all the time; these changes being at least partially dependent on which part of the world the vehicle is being used and on the needs of the individual driver/passenger. With known techniques, it is relatively complicated to install an extra antenna, for example, for utilization with GPS navigation in an existing vehicle. Among others, complicating reasons include required modifications to mount the antenna, as well as connect the antenna by means of a cable to the tuner which may be arranged at the other end of the vehicle.

For antennae that are mounted in the windowpanes of the vehicle, the need for an additional antenna may cause a change of windowpane.

In view of the above described deficiencies associated with the implementation and use of known antennae designs, the present invention has been developed to alleviate these drawbacks and provide further benefits to the user. These enhancements and benefits are described in greater detail hereinbelow with respect to several alternative embodiments of the present invention.

SUMMARY OF THE INVENTION

The present invention in its several disclosed embodiments alleviates the drawbacks described above with respect to conventionally designed antenna units and incorporates several additional beneficial features.

Among the several objects of the present invention, one is to enable a joint assembly of several antennae and tuners. Another is to eliminate the need for long coaxial cables that connect the antennae and tuners, and thus eliminate the need for antenna boosters. Yet another is to provide a cost-efficient mounting of antennae when a large number of antennae is required.

According to the present invention, these objects are achieved by an antenna unit of a type, stated by way of introduction, which is characterized in that the output signals from the tuner units are connected to a common coordinating means, arrangement or unit. The antennae, tuner units and coordinating means are arranged on a common supporting element to form an integrated unit. An output signal from the coordinating means, via a communication interface, is connectable to a vehicle-internal communication path.

Several antennae can thus be arranged on a common supporting element which is then mounted in the vehicle. By arranging the receivers (tuners) in connection with the antennae on the same supporting element, the need for long lines between antenna and tuner is eliminated. At the same time, the mounting of antennae and tuners is further simplified. By the output signals from several tuners being multiplexed by the coordinating means, a multiplexed signal can be made available on an internal communication path of the vehicle. When the antenna unit has been mounted in the vehicle, only a connection to the communication path is thus required for a plurality of received signals to be available all over the vehicle.

The communication path is suitably a databus of known design, which may comprise, for example, an optical cable.

An antenna can be connected to several tuners, and a tuner may be connected to several antennae. The connection which is most convenient is determined by the properties of the antennae and the signals which are to be received.

According to a preferred embodiment, antennae and tuner units are releasably arranged on the supporting element. This facilitates mounting and replacement of antennae and tuner units, while at the same time permitting adaptation of such an antenna module to different configurations and markets.

Each antenna and each tuner which is arranged on the printed circuit board can thus be removed or changed in one simple operation. A vehicle that, on delivery, is not equipped with an antenna for receiving a signal of a certain kind, can in a simple operation be provided with this antenna and the corresponding tuner. Thus the signal is made available on the internal databus of the vehicle and can be arranged in a suitable position, for example where equipment utilizing the signal at issue is mounted.

In particular this modularized antenna unit is suitable when each antenna is relatively expensive, which is the case, for example, with GPS antennae and satellite radio antennae.

Since many antenna categories, such as radio or TV antennae, require a relatively large space in at least two dimensions, antennae of this type are suitably fixedly arranged on the supporting element.

According to a preferred embodiment, the supporting element includes a planar sheet of a non-conductive material, for example plastic, in order to interfere as little as possible with the reception. The sheet can be mountable in a plane proximate the body on the upper side of the vehicle. This arrangement of the antenna unit is advantageous owing to its great distance to the roadway as well as to the engine, both of which may cause interference in the reception. By this embodiment of the invention, a superior alternative to arranging antennae in the windowpanes of the vehicle is provided.

If the body of the vehicle is made of a conductive material, the antenna unit is suitably mountable in a recess in the body. This prevents capacitance from arising between antennae and the conductive vehicle body.

The beneficial effects described above apply generally to the exemplary devices and mechanisms disclosed herein for an antennae arrangement. The specific structures through which these benefits may be delivered will be described in detail hereinbelow.

BRIEF DESCRIPTION OF THE DRAWINGS

The invention will now be described in greater detail in the following way, by example only, and with reference to the attached drawings, in which.

DETAILED DESCRIPTION OF THE INVENTION

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular arrangements, components or processes. Therefore, specific structural and functional details disclosed herein are not to be interpreted as limiting, but merely as a basis for the claims and as a representative basis for teaching one skilled in the art to variously employ the present invention.

Figure 1:
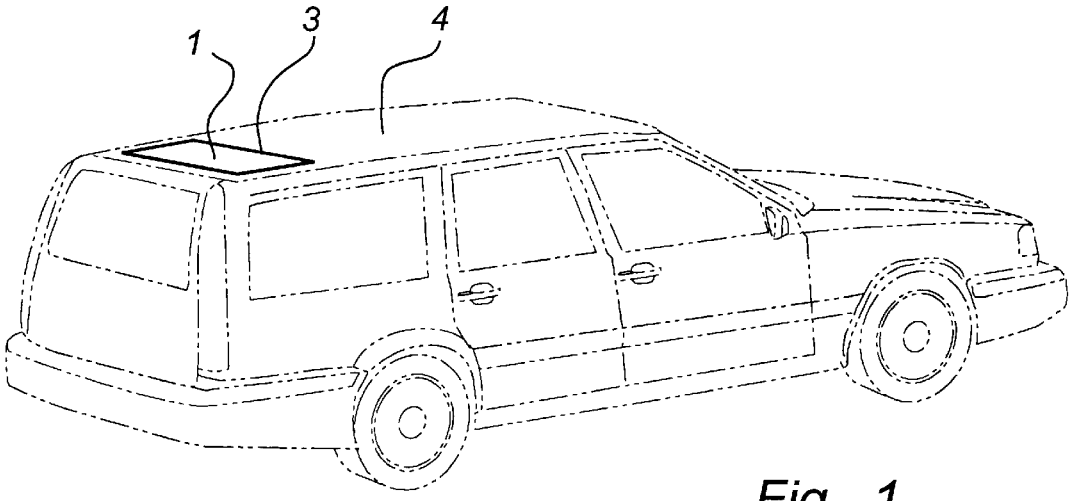
FIG. 1 shows an antenna unit according to the invention mounted in a station wagon-style automobile.

FIG. 1 shows how a preferred embodiment of an antenna unit 1, according to the invention, is mounted at the rear end of the roof of, for example, a station wagon 2. In this case, a recess 3 is formed in the body 4 of the vehicle 2 and the antenna unit 1 is mounted therein.

The antenna unit 1 is fixed in the recess 3 by an adhesive 5 (see FIG. 4) such as, for example, polyurethane adhesive, that is applied along the joints.

If the body 4 is made of a conductive material such as sheet metal, it is particularly necessary that the recess 3 be formed in the body 4 of the vehicle 2 to prevent capacitance from arising between the vehicle body 4 and the antennae of the antenna unit 1. If the body 4 of the vehicle 2 is instead made of a non-conductive material, such as plastic or fiber material, it is not necessary to provided such a recess 3. In this case, the antenna unit 1 can be mounted from below, directly on the inside of the body 4.

In the illustration, the recess 3 is essentially of the same width as the entire vehicle 2, and approximately one third of its length. In front of and behind the recess 3, the body 4 is provided with reinforcing means, element or arrangement 6 (see FIG. 4) so as not to deteriorate the stability of the vehicle in the region of the recess 3.

Figure 2:
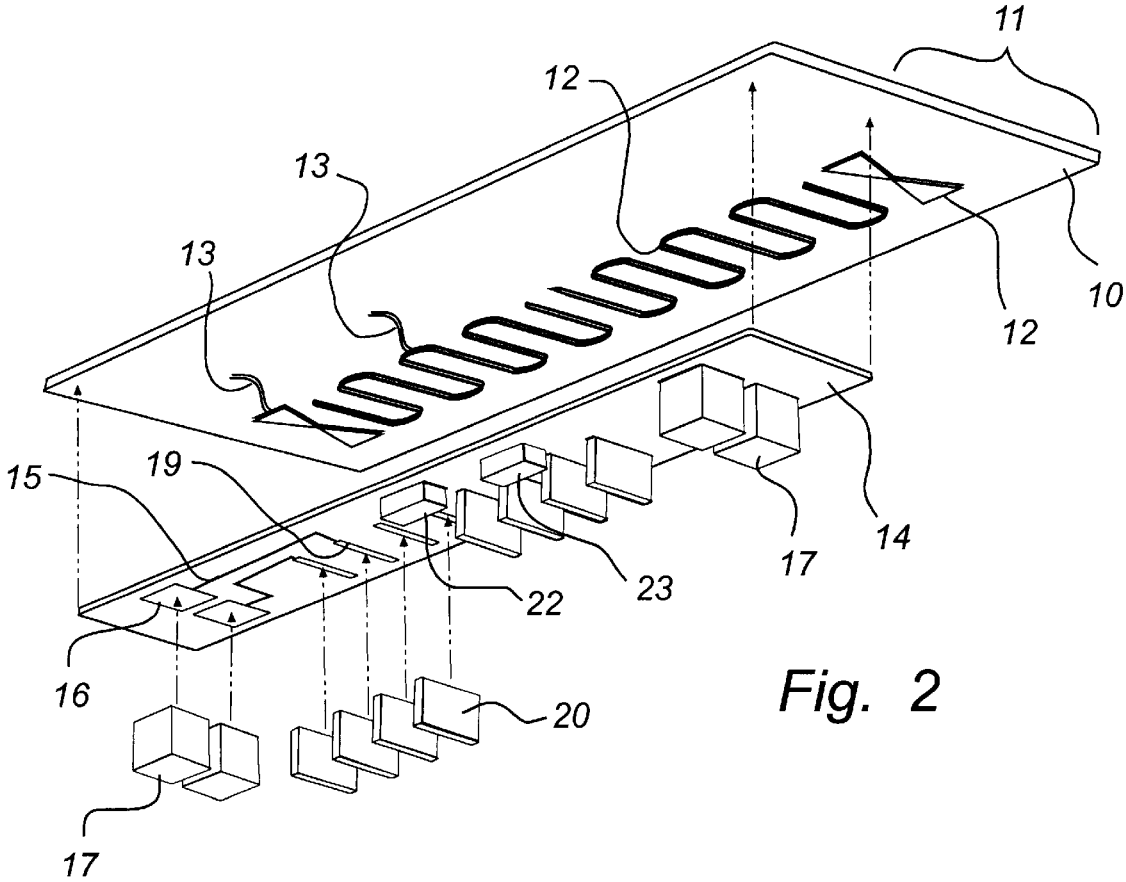
FIG. 2 is an exploded view of the antenna arrangement or unit whose location is depicted in FIG. 1 on an automobile.

With reference to FIG. 2, the antenna unit 1 comprises a supporting element 10, preferably in the form of a sheet of a suitable non-conductive material, such as plastic, of the same size and shape as the recess 3.

In an area 11 at the underside of the supporting element 10, a plurality of antennae 12 are arranged, preferably in a fixed configuration, for example by means of an adhesive or by being cast into the supporting element 10. The antennae 12 that are arranged in this area 11 thus have an essentially two-dimensional orientation in, or parallel to, the plane of the supporting element 10. In the first place, the antennae 12 are of the monopole- and/or dipole-type which can each have an arbitrary curvature in the plane defined by the supporting element 10. Examples of suitable antennae are wire antennae and foil antennae.

The antennae 12 operate in a known manner for receiving electromagnetic waves, preferably in frequency ranges in the order of between about 100 kHz up to 1 Ghz. According to at least one embodiment of the invention, antennae for radio signals (FM and AM), TV signals, ground based DAB (Digital Audio Broadcast) and signals for navigation and information systems, e.g. Traffic Message Channel (TMC), Vehicle Information Control System (VICS) and Road and Traffic Information (RTI) are arranged in this manner on the supporting element.

A coupling element 14 with line paths 15 formed thereon, is preferably significantly smaller than the supporting element 10 and is arranged on the supporting element 10 at the side of the antennae 12 with lines 13 connected thereto. In the illustrative example, the coupling element 14 is a printed circuit board 14, which covers the entire width of the supporting element 10, but only about one fourth of its length.

Receivers or means 16 are arranged on the printed circuit board 14 for releasably accepting and/or arranging a plurality of additional antennae 17 on the printed circuit board 14. In the illustration, four additional antennae 17 are contemplated. Each receiver or means 16 comprises fixing means or arrangement for fixedly arranging the antenna 17 on the printed circuit board 14. Contact arrangements or means are provided for connecting the antenna 17 to the line paths 15 formed on the printed circuit board 14. Each antenna 17 is preferably cast into a protective casing which contributes to giving the antenna a format which is easy to handle, such as a rectangular parallelepiped.

The antennae 17 cane, for example, helix antennae or patch antennae and are preferably adapted to receive and/or transmit signals in the GHz range, i.e. electromagnetic waves in frequency ranges of the order 1 GHz and upwards. Examples of such signal types include GSM, GPS, satellite DAB and satellite telephone.

Receivers or securement means 19 are arranged on the printed circuit board 14 for releasably accepting and arranging a plurality of tuner units 20 on the printed circuit board 14. Like the receiver means 16 for arranging the antennae 17, these tuner receiver means 19 comprise anchors or fixing means for fixedly arranging the tuner unit 20 on the printed circuit board 14 and contacts or contact means for connecting the tuner unit 20 to the line paths 15 formed on the printed circuit board 14.

A coordinator or coordinating means 22, for example a multiplexor 22, is arranged on the printed circuit board 14 to multiplex a plurality of input signals into an output signal. A communication interface 23, which operates as an interface with a vehicle's internal communication path, preferably takes the form of a databus running around the vehicle in a loop 25 which may consist of e.g., a conductive metal cable or an optical cable.

Figure 3:
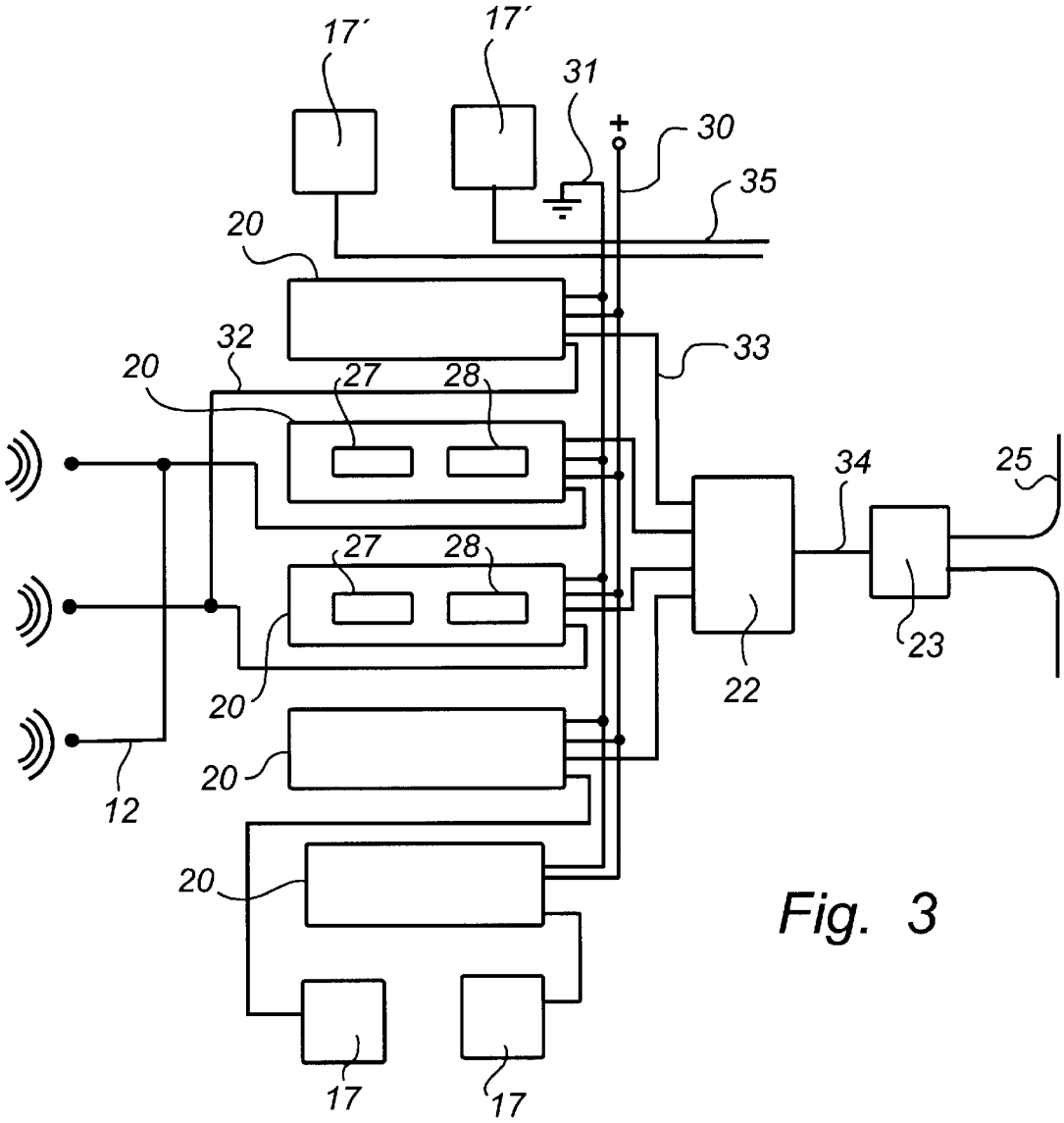
FIG. 3 is an electrical schematic diagram of the antenna unit of FIG. 2.

The parts included in the antenna unit 1 are exemplarily electrically interconnected in the manner as shown in FIG. 3. The connections are accomplished by means of the line paths 15 on the printed circuit board 14 and the lines 13 between the antennae 12 and the printed circuit board 14.

Each tuner unit 20 is connected to at least one of the antennae 12,17. Particularly in regard a radio tuner, it may be advantageous to connect such a tuner to two of the antennae 12 for improved reception.

The contact arrangement or means that connects each tuner unit 20 to the printed circuit board 14 also advantageously accommodates communication of the input signals operating voltage 30, ground 31, antenna signal 32 and the output signal 33 from the tuner unit 20. Either the tuner 27 within the tuner unit 20 works digitally (for example, a GSM tuner), or, in the case of an analog tuner 27 such as a radio tuner, the output signal from the analog tuner 27 is converted from analog to digital so that the output signal 33 from each tuner unit 20 is digital. Therefore, in addition to the tuner 27, each tuner unit 20 may comprise an analog-to-digital converter as appropriate. It goes without saying that the analog-to-digital converter can be fixedly mounted on the printed circuit board, with only the tuner being releasable. However, this requires that the output signal of the tuner be analog, which can be restricting.

The output signals 33 are connected to the multiplexor 22 where they are multiplexed to a common signal 34. This signal is received by the communication interface 23 which communicates with the databus 25. The signal processing in the entire antenna unit 1, from antennae 12, 17, via tuner unit 20 and multiplexor 22, to the communication interface 23 with the databus 25, can be accomplished utilizing known techniques appreciated by those persons skilled in the art.

According to at least one embodiment of an antenna unit 1 configured according to the present invention, at least one antenna 17' (see FIG. 3) which transmits and receives GSM signals is not connected to a tuner arranged on the printed circuit board 14. It is instead, via a line 35, for instance a coaxial cable, connected to a telephone (not shown) adjacent to the driver's seat. The reason for this solution is that the mobile telephone system is included in the safety system of the vehicle and therefore should not be dependent on the databus.

Figure 4:
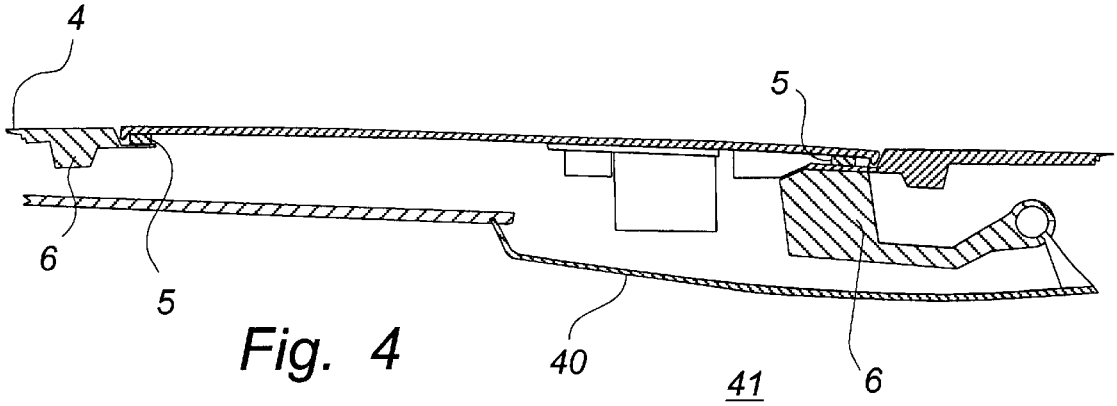
FIG. 4 is a partial cross-sectional view of the antenna unit installed in a vehicle as illustrated in FIG. 1.

The printed circuit board 14 is, as is evident from FIG. 4, covered underneath with preferably, a foldable flap 40 to make it easy to reach the printed circuit board from the trunk 41 of the vehicle if the unit 1 is installed in that region of a vehicle. A locking arrangement or locking means (not shown) of various types can, of course, be arranged in connection with the flap 40 to prevent unauthorized persons from having access, intentionally or unintentionally, to the several components 17, 20, 22, 23 arranged on the printed circuit board 14.

It will be appreciated that the above preferred embodiments of the present invention are to be considered as examples only and that several variants are feasible within the scope of the inventive idea as defined in the appended claims.

For instance, the number and type of components, such as antennae and tuners, may be varied. The antenna unit may also comprise transmitters, which in the same way as the receivers, are arranged on the printed circuit board and at least one antenna.

The vehicle can be of arbitrary model and category and need not necessarily be a station wagon as shown in the drawings.

What is claimed and desired to be secured by Letters Patent is as follows:

1. An antenna unit for receiving electromagnetic signals in a vehicle, said antenna unit comprising:

a plurality of antennae and a plurality of tuners, wherein each tuner is connected to an antenna and output signals from said tuners are fed to a multiplexor;

said antennae, tuners and multiplexor are arranged on a common supporting element to form an integrated unit; and a communication interface adapted to communicate an output signal from the multiplexor to a vehicle internal communication path.

2. The antenna unit as recited in claim 1, wherein at least one of the antennae is adapted to receive signals in the GHz range.

3. The antenna unit as recited in claim 1, wherein at least one antenna has an essentially two-dimensional spatial configuration.

4. The antenna unit as recited in claim 1, wherein at least one antenna is adapted to be releasably arranged on the common supporting element.

5. The antenna unit as recited in claim 1, wherein at least one tuner is adapted to be releasably arranged on the supporting element.

6. The antenna unit as recited in claim 1, wherein at least one antenna is fixedly arranged on the surface of the supporting element.

7. The antenna unit as recited in claim 1, wherein the supporting element comprises an essentially planar sheet of a non-conductive material adapted to be mountable in the plane of the body at the upper side of the vehicle.

8. The antenna unit as recited in claim 1, wherein said antenna unit is adapted to be mountable in a recess in the body of the vehicle when the body of the vehicle is constructed from conductive material.

9. The antenna unit as recited in claim 1, wherein at least one antenna is connected to a plurality of tuners.

10. The antenna unit as recited in claim 1, wherein the communication path comprises a databus.

11. The antenna unit as recited in claim 1, wherein the communication path comprises an optical cable.

* * * * *